US006020650A

United States Patent [19]

Soh

[11] Patent Number: 6,020,650

[45] Date of Patent: Feb. 1, 2000

[54] ELECTROMAGNETIC SWITCH HAVING VARIABLE MAGNETIC RESISTANCE

[75] Inventor: Masahiro Soh, Anjo, Japan

[73] Assignee: Denso Corporation, Kariya, Japan

[21] Appl. No.: 08/946,833

[22] Filed: Oct. 8, 1997

[30] Foreign Application Priority Data

Oct. 9, 1996 [JP] Japan ..... 8-268859
Jul. 1, 1997 [JP] Japan ..... 9-175378

[51] Int. Cl.[7] ..... F02N 11/00

[52] U.S. Cl. ..... 290/38 A; 290/38 R; 74/7 R

[58] Field of Search ..... 290/38 A, 38 R, 290/48; 74/7 A, 7 R, 7 E; 123/179.3; 335/77, 80

[56] References Cited

U.S. PATENT DOCUMENTS

| | | | |
|---|---|---|---|
| 4,262,546 | 4/1981 | Mazzorana | 74/7 A |
| 4,720,639 | 1/1988 | Sakayanagi et al. | 280/38 R |
| 5,103,107 | 4/1992 | Yamamoto et al. | 290/48 |
| 5,126,583 | 6/1992 | Isozumi et al. | 290/48 |
| 5,138,986 | 8/1992 | Aguilar | 123/179.3 |
| 5,332,926 | 7/1994 | Ueno et al. | 307/10.6 |
| 5,383,428 | 1/1995 | Fasola et al. | 123/179.3 |
| 5,508,566 | 4/1996 | Nagao et al. | 290/38 R |
| 5,610,445 | 3/1997 | Shiga et al. | 290/38 R |
| 5,760,487 | 6/1998 | Kimura et al. | 290/48 |

FOREIGN PATENT DOCUMENTS

| | | |
|---|---|---|
| 725216A2 | 8/1996 | European Pat. Off. . |
| 4431670A1 | 3/1995 | Germany . |
| 50-5807 | 1/1975 | Japan . |
| 1222749 | 2/1971 | United Kingdom . |

OTHER PUBLICATIONS

Journal of Nippondenso Technical Disclosure, No. 55–102, published on Sep. 15, 1987.
Journal of Nippondenso Technical Disclosure, No. 55–103, published on Sep. 15, 1987.

*Primary Examiner*—Nicholas Ponomarenko
*Attorney, Agent, or Firm*—Pillsbury Madison & Sutro LLP

[57] ABSTRACT

In an electromagnetic switch for a starter, a plunger is housed to face a grounding plate through an air gap in the inner circumference of an attraction coil. When the attraction coil is energized and magnetic flux flows in the magnetic circuit, the plunger is attracted toward the grounding plate by the magnetic force. The plunger has a hollow recess as a variable magnetic resistance member at its bottom end which is opposite to the air gap. The hollow recess extends inwardly from the bottom surface of the plunger by a predetermined length and is closed by a plug body fitted in the opening to have a closed hollow space. The variable magnetic resistance member may be provided by a reduced diameter part in place of or in combination with the hollow recess.

10 Claims, 6 Drawing Sheets

ELECTROMAGNETIC SWITCH HAVING VARIABLE MAGNETIC RESISTANCE

CROSS REFERENCE TO RELATED APPLICATION

This application incorporates herein by reference Japanese Patent applications No. 8-268859 filed on Oct. 9, 1996 and No. 9-175378 filed on Jul. 1, 1997.

BACKGROUND OF THE INVENTION

1. Field of the Invention

The present invention relates to an electromagnetic switch having a variable magnetic resistance and, more particularly an electromagnetic switch suitable for a starter for starting an engine.

2. Related Art

Various electromagnetic switches are used in conventional starters. The starter disclosed in JP-A 50-5807, for instance, has a pinion gear which is helical spline-fitted on the outer periphery of an output shaft and a rotation restricting member which restricts the rotation of the pinion gear. The rotation restricting member is driven by the attraction force of an electromagnetic switch at the time of a start of the rotation of an armature thereby to restrict the rotation of the pinion gear, so that the pinion gear is moved axially by the thrust force generated by the helical spline to engage with the ring gear of an engine.

According to this rotation restricting type, in comparison with the type in which the pinion gear is pushed out by the attraction force of the electromagnetic switch through a drive spring (spring force characteristics line C2 in FIG. 4) to engage with the ring gear, the spring force for operating the electromagnetic switch can be decreased (spring force characteristics line C1 in FIG. 4). As a result, the attracting force (required attracting force) of the electromagnetic switch can be decreased correspondingly, and the size and weight of the electromagnetic switch can be advantageously reduced.

In the above starter of the type which restricts the rotation of the pinion gear, the decrease in the spring force is so large that the attracting force characteristics of the electromagnetic switch exceeds greatly the spring force as the air gap in the electromagnetic switch becomes smaller. The attraction force of the plunger of the electromagnetic switch rises too high, causing the movable contact attached to the plunger to bounce at the time of abutting the fixed contact. As a result, due to the chattering (repetition of engagement and disengagement) of the movable contact, the life of the contact is shortened.

SUMMARY OF THE INVENTION

The present invention has an object to provide an electromagnetic switch which obviates the above drawbacks.

The present invention has another object to provide an electromagnetic switch for a starter in which chattering of switch contacts is restricted to improve the life of the contacts by increasing a magnetic resistance in a magnetic circuit or reducing an attraction force of a plunger as an air gap in the magnetic circuit is reduced.

According to the present invention, an electromagnetic switch has a variable magnetic resistance member which increases the magnetic resistance of a magnetic circuit at the time a plunger is attracted and an air gap is decreased. As the magnetic resistance of the magnetic circuit is increased by the variable magnetic resistance member, the attraction force of the electromagnetic switch is decreased to restrict the excess attraction force in excess of a contact spring force. As a result, the attraction speed of the plunger is lowered to restrict switch contacts from chattering and to prolong the life of the contacts. The variable magnetic resistance member is placed outside the magnetic circuit while the air gap is large, so that the required large attraction force may be assured at the time of starting of operation.

Preferably, as the variable magnetic resistance member, a hollow recess may be provided at an end of the plunger at a position opposite to the side of the air gap of the plunger. As the plunger is attracted to reduce the air gap, the hollow recess reduces the cross sectional area of the magnetic path in the plunger to reduce the attraction force of the electromagnetic switch by the magnetic saturation thereby suppressing the excess attraction force. The hollow recess in the plunger reduces the weight of the plunger as well, suppressing the influence of vibration which is caused by an engine.

More preferably, a low permeability member such as a nonmagnetic material, e.g., resin, may be filled in the hollow recess.

Alternatively, as the variable magnetic resistance member, the outer diameter of the end of the plunger opposite to the side of the air gap may be reduced. According to this construction, when the plunger is attracted and the small diameter end comes into the magnetic circuit, a gap between a small diameter end of the plunger and a magnetic member forming a part of the magnetic circuit opposing the outer periphery of the plunger increases so that the magnetic resistance between the small diameter end and the magnetic member increases. The reduction in the plunger outer diameter will result in the light weight construction.

Preferably, the electromagnetic switch has within the hollow recess of the plunger a contact spring which applies a contact pressure to the movable contact. In comparison with the case in which a contact spring is disposed near a movable contact, the construction near the movable contact can be simplified. Further, the leakage of the magnetic flux from the contact spring at a large air gap position where a large attraction force is required is suppressed to effectively use the attraction force.

BRIEF DESCRIPTION OF THE DRAWINGS

Other objects, features and advantages of the present invention will be made more apparent by the following detailed description with reference to the accompanying drawings, in which.

DETAILED DESCRIPTION OF THE PREFERRED EMBODIMENT

Figure 1:
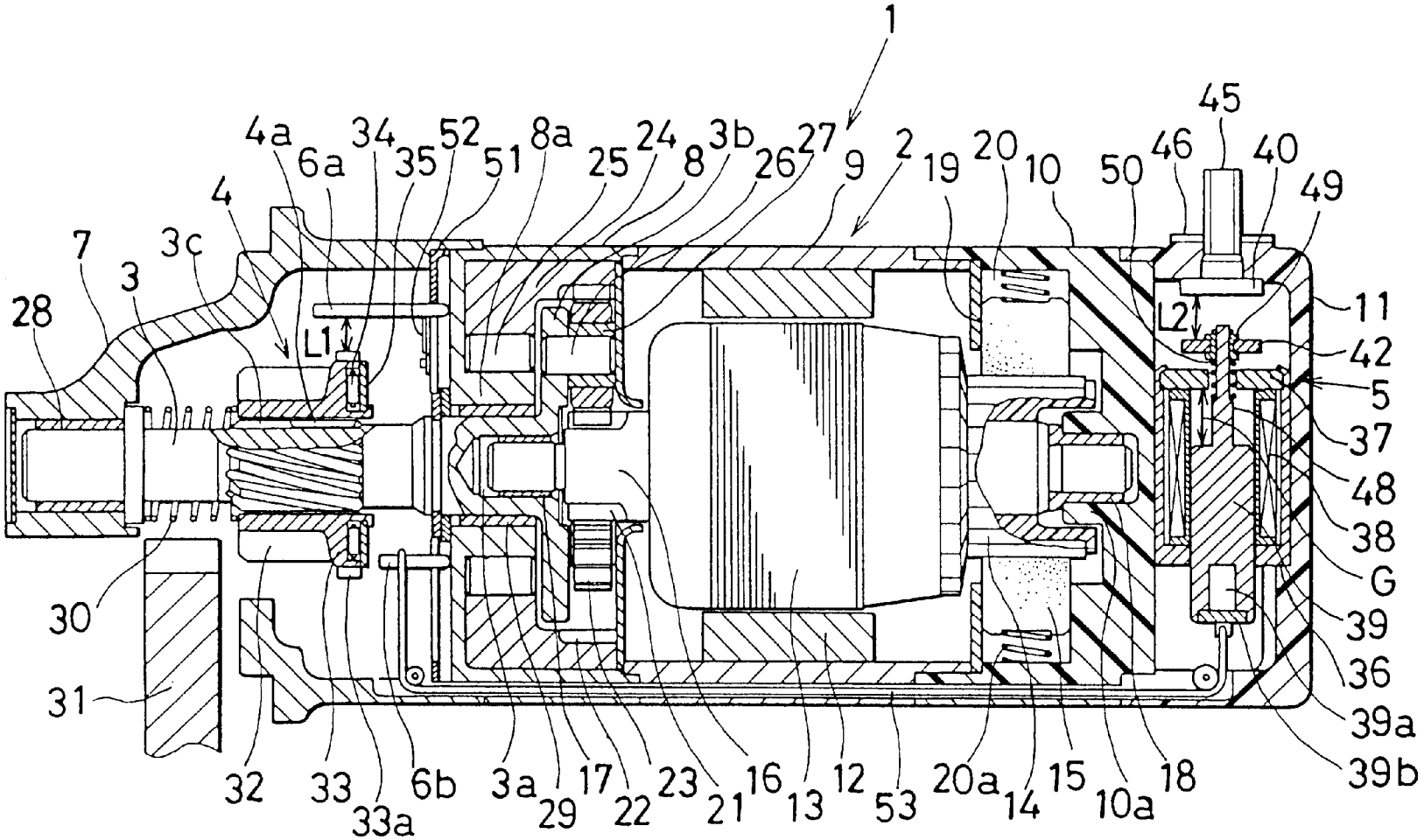
FIG. 1 is a cross sectional view of a starter using an electromagnetic switch according to a first embodiment.

An electromagnetic switch according to the present invention will be described next with reference to various embodiments applied to a starter, in which the same or like parts are designated by the same or like reference numerals.

(First Embodiment)

A starter 1 shown in FIG. 1 has a starter motor 2 which generates a rotating force, a planetary gear reduction mechanism (described later) which reduces the rotation speed of the starter motor 2, an output shaft 3 which rotates receiving the rotation output of the reduction mechanism, a pinion moving member 4 which is helical spline-fitted on the output shaft 3, an electromagnetic switch 5 which controls the electric power supply to the starter motor 2 and the movement of the pinion moving member 4, a rotation restricting member 6 (FIG. 3) which restricts the rotation of the pinion moving member 4 before the starter motor 2 starts to rotate, and a frame body (front casing 7, center casing 8, yoke 9, brush holder 10 and rear casing 11) which provides a generally cylindrical outer configuration.

In the frame body, the front casing 7, center casing 8, yoke 9, brush holder 10 and rear casing 11 are placed in the named order from the side of an engine (left side in FIG. 1) and tightly fastened by through bolts.

In the starter motor 2, fixed magnetic poles (e.g., a plurality of permanent magnets) 12 are fixed to the inner circumferential surface of the yoke 9 which constitutes a part or the frame body and a magnetic circuit frame. An armature 13 is rotatably placed inside the fixed magnetic poles 12, and brushes 15 are placed on a commutator 14 provided at the rear end of the armature 13.

The yoke 9 is fitted in the spigot-joint form with the opening end of the center casing 8 at one axial end side thereof and with the opening end of the brush holder 10 at the other axial end side thereof.

The armature 13 has a rotary shaft 16 which has one axial end fitted into a recess 3*a* formed in the rear end of the output shaft 3 and rotatably supported by a bearing 17 fitted in the inner circumferential surface of the recess 3*a* and the other axial end rotatably supported by a bearing 18 held in a bearing part 10*a* of the brush holder 10.

The commutator 14 has a plurality of commutating pieces assembled in a cylindrical form around the outer circumference of the other end side of the rotary shaft 16.

Each brush 15 is placed on the radially outer circumference of the commutator 14 and is held in a brush holding chamber 20 provided by the recess of the brush holder 10 and a plate 19. The brush 15 is biased to the outer circumferential surface of the commutator 14 by a spring 20*a*. The brush is disposed slidably in the radial direction (up-down direction in FIG. 1) in the brush holding chamber 20 and is restricted from moving in the rotation direction.

The reduction mechanism includes a sun gear (outer teeth) 21 formed on the outer circumference at the side of the one axial end of the output shaft 16, an internal gear (inner teeth) 22 placed on the radially outer circumference of the sun gear 21, and a plurality of planetary gears placed between the sun gear 21 and the internal gear 22 to mesh with both of the gears 21 and 22. The internal gear 22 is formed on the inner surface of a gear forming member 24 disposed radially inside the center casing 8. The gear forming member 24 provides a one-way clutch together with the inner cylindrical part 8*a* of the center casing 8 located radially inside the gear forming part 24 and rollers 25 disposed between the inner cylindrical part 8*a* and the gear forming part 24. Due to the one-way clutch function, the gear forming part 24 is not rotatable and rotatable against the center casing 8 in the direction of rotation of the armature 13 and in the direction opposite to the rotation of the armature 13, respectively.

The planetary gears 23 are supported rotatably by bearings 27 fitted on the outer circumferences of pins 26 which are press-fitted into the radially enlarged part 3*b* formed at the outer circumference of the rear end of the output shaft 3.

The output shaft 3 is disposed coaxially with the armature rotary shaft 16, and has one axial end supported rotatably by a bearing 28 supported by the front casing 7 and the other axial end supported rotatably by a bearing 29 supported by the inner cylindrical part 8*a* of the center casing 8 so that it is restricted from moving axially against the center casing 8. A helical spline 3*c* is formed on a part of the outer circumferential surface of the output shaft 3 protruding forward (left direction in FIG. 1) from the center casing 8.

The pinion moving member 4 is mounted movably on the output shaft 3 with its helical spline 4*a* formed on the inner circumference being fitted with the helical spline 3*c* of the output shaft 3. It is biased normally by a return spring 30 disposed at the front side toward the rear side (right direction in FIG. 1) of the starter 1. The pinion moving member 4 is formed integrally with a pinion gear 32 which is engageable with a ring gear 31 of the driving shaft of the engine. The pinion gear 32 is formed integrally at its rear side (right end side in FIG. 1) with a flange 32 which has a larger diameter and a number of teeth 33*a* on its outer circumference. A thrust washer 35 is disposed rotatably through rollers 34 at the rear end surface of the pinion moving member 4.

The electromagnetic switch 5 is disposed at the rear side of the brush holder 10 and housed within the rear casing 11 which is cup-shaped.

The electromagnetic switch 5 has a cylindrical frame 36 having a bottom opening at the bottom center and an upper opening, a grounding plate 37 fixed to the upper opening of the frame 36, an attraction coil 38 housed within the frame 36, a plunger 39 extending through the bottom opening of the frame 36 and disposed movably in the up-down direction within the inner circumference of the attraction coil 38, and the like. The plunger 39 opens and closes a motor switch (described later) provided in a power supply circuit (FIG. 2) of the starter motor 2 in accordance with its movement.

The frame 36, grounding plate 37 and plunger 39 are made of magnetic materials to provide a magnetic circuit in the electromagnetic switch 5.

The plunger 39 faces the grounding plate 37 through an air gap G provided radially inside the attraction coil 38 so that it may receive the magnetic force exerting between the grounding plate 37 and the plunger 39 to be attracted toward the grounding plate 37 (upward in FIG. 1) when the magnetic flux flows in the magnetic circuit by the power supply to the attraction coil 38. The plunger 39 has a hollow recess 39*a* at its lower or bottom end. The hollow recess 39*a* is formed to extend inwardly or longitudinally from the bottom of the plunger 39 by a predetermined length up to around the bottom surface of the frame 36. The hollow recess 39*a* is closed at its bottom end by a plug body 39*b* to provide a closed hollow space.

Figure 2:
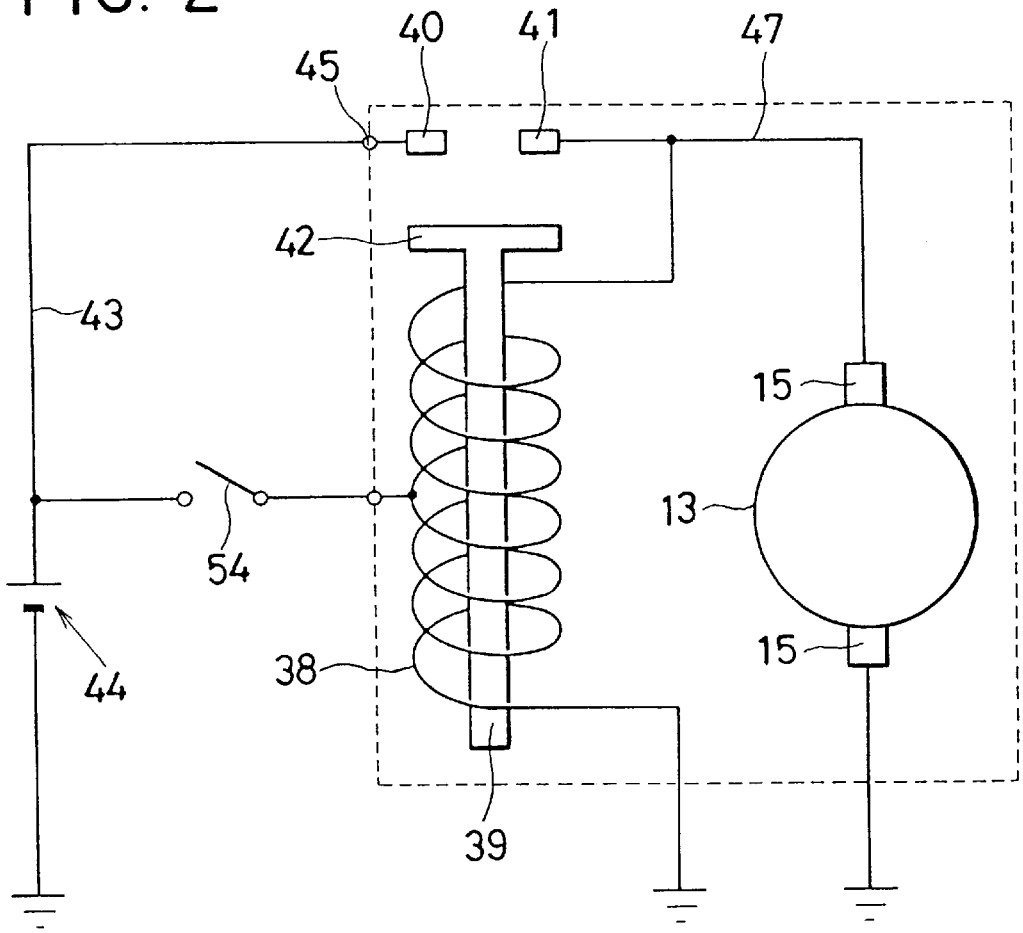
FIG. 2 is an electric wiring diagram of a power supply circuit for a starter motor.

The motor switch has, as shown in FIG. 2, a battery-side fixed contact 40, a motor-side fixed contact 41 and a movable contact 42.

The battery-side fixed contact 40 is formed integrally with a battery terminal 45 connectable to a battery 44 through a cable 43 and placed to face the movable contact 42 inside the rear casing 11. The battery terminal 45 is formed with a thread on the outer circumference for a thread-engagement with a nut (not shown). The thread extends outwardly from the rear casing 11 and is fixed to the rear casing 11 by a washer 46.

The motor-side fixed contact 41 is electrically connected to the positive-side brush 15 through a lead wire 47 and is placed to face the movable contact 42 in the rear casing 11.

The movable contact 42 is attached through an insulating member 49 to the end of a rod 48 integrally formed with the plunger 39 and extending through the opening of the grounding plate so that it moves with the plunger 39 to close the motor switch by engaging (electrically contacting) with the fixed contacts 40 and 41 and to open the motor switch by disengaging from the fixed contacts 40 and 41. The movable contact 42 is biased by the contact spring 50 through the insulating material 49 at the time of abutting with the fixed contacts 40 and 41 so that it may be maintained in contact with the fixed contacts 40 and 41 with the contacting pressure. The rod 48 protrudes upward from the top end central part and passes through the opening formed in the central part of the grounding plate 37. The contact spring 50 is disposed around the rod 48 with its one end being hooked on the insulating member 49 and its other end being hooked on the stepped surface formed on the outer circumference of the rod 48.

Figure 3:
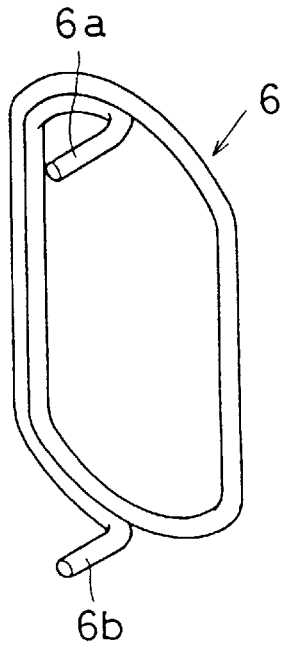
FIG. 3 is a perspective view of a rotation restricting member used in the starter shown in FIG. 1.

The rotation restricting member 6 is formed, as shown in FIG. 3, by winding a metal rod for instance in a coil form and bending both ends 6*a* and 6*b* in the same direction at substantially the right angle. The rotation restricting member 6, with its coiled part being disposed within a space defined between the end surface of the center casing 8 and a plate 51 fixed to the front side of the center casing 8, is placed movably in the up-down direction in FIG. 1 against the plate 51 and the center casing 8. It is biased normally upward in FIG. 1 by a spring 52 fixed to the plate 51.

Both ends 6*a* and 6*b* bent at the right angle are protruded forward from the plate 51 through openings formed in the plate 51. One end 6*a* is located radially outside the flange 33 of the pinion moving member 4 at the side radially above the output shaft 3, while the other end 6*b* is located rearward of the thrust washer 35 of the pinion moving member 4 at the side radially below the output shaft 3. The end 6*a* has a length by which it is enabled to engage with the teeth 33*a* formed on the flange 33 of the pinion moving member 4 when the rotation restricting member 6 is moved downward, even in the case where the pinion moving member 4 moves forward a predetermined distance on the output shaft 3 (for instance, the end surface of the pinion gear 32 moves to the position to abut the end surface of the ring gear 31). The one end of a cord-like member 53 which transmits the attraction force of the electromagnetic switch 5 to the rotation restricting member 6 is connected to the other end 6*b*. The other end of the cord-like member 53 is connected to the plug body 39*b* fitted into the bottom of the plunger 39.

The rotation restricting member 6 moves downward in FIG. 1 against the biasing force of the spring 52 when the attraction force of the electromagnetic switch 5 (movement of the plunger 39) is transmitted through the cord-like member 53, while it returns to its original position (position shown in FIG. 1) by the biasing force of the spring 52 when the attraction force of the electromagnetic switch 5 disappears.

Assuming that, under the rest condition (non-operating condition) of the starter 1, the distance between the one end 6*a* of the rotation restricting member 6 and the outer circumference of the flange of the pinion moving member 4 is L1 and the distance between the movable contact 42 of the electromagnetic switch 5 and the fixed contacts 40 and 41 is L2, the distances L1 and L2 are determined to satisfy the following relation, $L1 \leqq L2$.

The starter 1 having the electromagnetic switch 5 according to this embodiment operates as follow.

When the key switch 54 (FIG. 3) is closed, the electric current flows from the battery 44 to the attraction coil 38 of the electromagnetic switch 5 to generate the magnetic force which in turn attracts the plunger 39 upward in FIG. 1. The other end 6*b* of the rotation restricting member 6 is pulled downward by the cord-like member 53 so that the rotation restricting member 6 moves downward in FIG. 1 flexing the spring 52. Thus, the one end 6*a* of the rotation restricting member 6 engages with the teeth 33*a* formed on the flange 33 of the rotation restricting member 6 to restrict the rotation of the pinion moving member 4.

In the electromagnetic switch 5, in the mean time, the movable contact 42 abuts the fixed contacts 40 and 41 in response to the movement of the plunger 39 to close the motor switch so that the armature 13 starts to rotate with the electric current. It is to be understood that the rotation of the pinion moving member 4 is already kept restricted at the time when the motor switch is closed. The rotation of the armature 13 is reduced by the reduction mechanism and transmitted to the output shaft 3 which in turn rotates. Though the pinion moving member 4 tends to rotate with the rotation of the output shaft 3, the rotation of the output shaft 3 exerts as a thrust force on the pinion moving member 4 through the helical spline 3*c* with the pinion moving member 4 being restricted from rotating. As a result, the pinion moving member 4 advances forward on the output shaft 3 and the pinion gear 32 engages with the ring gear 31, so that the rotating force of the starter motor 2 is transmitted from the pinion gear 32 to the ring gear 31 for starting the engine.

After the engagement of the pinion gear 32 with the ring gear 31, the one end 6*a* of the rotation restricting member 6 disengages from the teeth 33*a* of the flange 33 and drops into the rear side of the thrust washer 35 provided on the rear side surface of the pinion moving member 4, thereby restricting the rearward movement of the pinion moving member 4.

When the key switch 54 is opened after the engine starting, the electric current to the attraction coil 38 is interrupted and the attraction force for the plunger 39 disappears. The rotation restricting member 6 is pushed back by the biasing force of the spring 52 upwardly in FIG. 1 to return to the original position. Thus, the one end 6*a* of the rotation restricting member 6 held in position to restrict the pinion moving member 4 from moving rearward disengages from the thrust washer 35 of the pinion moving member 4 to release the restriction on the rearward movement of the pinion moving member 4. As a result, the pinion moving member 4 moves rearward on the output shaft 3 to disengage the pinion gear 32 from the ring gear 31.

As the rotation restricting member 6 is pushed upward in FIG. 1, the plunger is pulled downwardby the cord-like member 53 so that the movable contact 42 disengages from the fixed contacts 40 and 41 to open the motor switch, thereby interrupting the power supply to the armature 13 to stop the rotation of the armature 13.

Though the plunger 39 is returned to the initial position by the use of the biasing force of the spring 52 in the present embodiment, a separate return spring may be provided specifically for pushing back the plunger 39.

Figure 4:
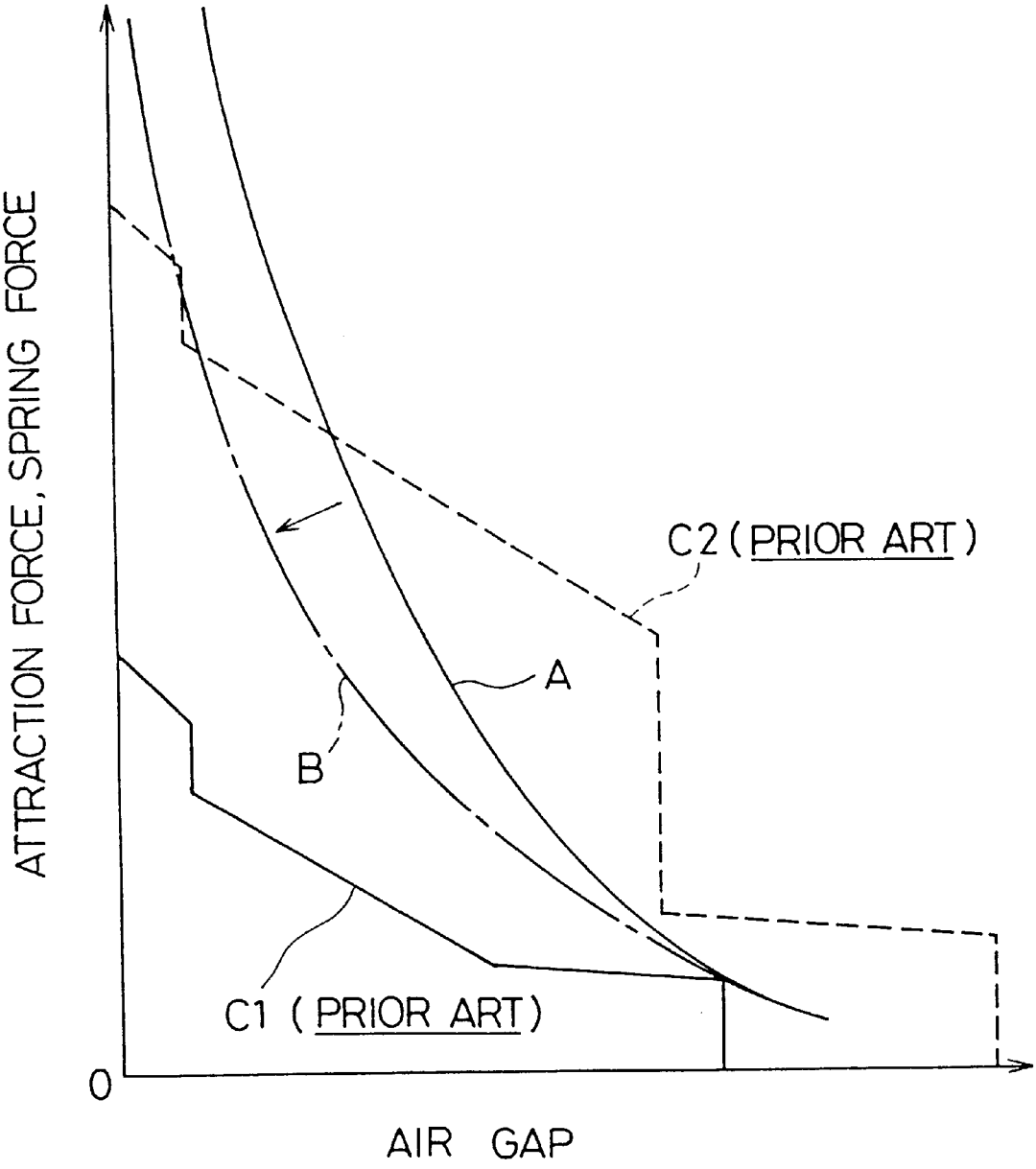
FIG. 4 is a graph showing a relation between an air gap and a spring load in the electromagnetic switch of FIG. 1.

In the electromagnetic switch 5 according to the present embodiment, the hollow recess 39*a* is provided as the variable magnetic resistance member at the lower part of the plunger 39. As a result, at the beginning of attracting the plunger 39 toward the grounding plate 37, the magnetic flux flows through the radially central part of the plunger 39 to provide a full attraction force and assure the required attraction force. As the plunger 39 is attracted further thereafter toward the grounding plate 37, the hollow recess 39*a* located below the bottom surface of the frame 36 gradually moves upward together with the plunger 39 to reduce the cross sectional area of the magnetic flux path of the plunger 39. Thus, the attraction force of the electromagnetic switch 5 is reduced (from the solid line A to the dot-chain line B in FIG. 4) by the magnetic saturation to limit the excess attraction force exceeding the spring force. As a result, the attraction speed of the plunger 39 lowers to suppress chatters of the contacts and prolong the life of the contacts.

Further, by the hollow recess 39*a* in the plunger 39, the weight of the plunger 39 is reduced to minimize the influence of vibration generated by the engine.

A low permeability material (for instance, non-magnetic material such as resin) may be disposed in the hollow recess 39*a* formed in the plunger 39. In this instance, the low permeability material may be filled in the hollow recess 39*a* entirely or only partly.

(Second Embodiment)

Figure 5:
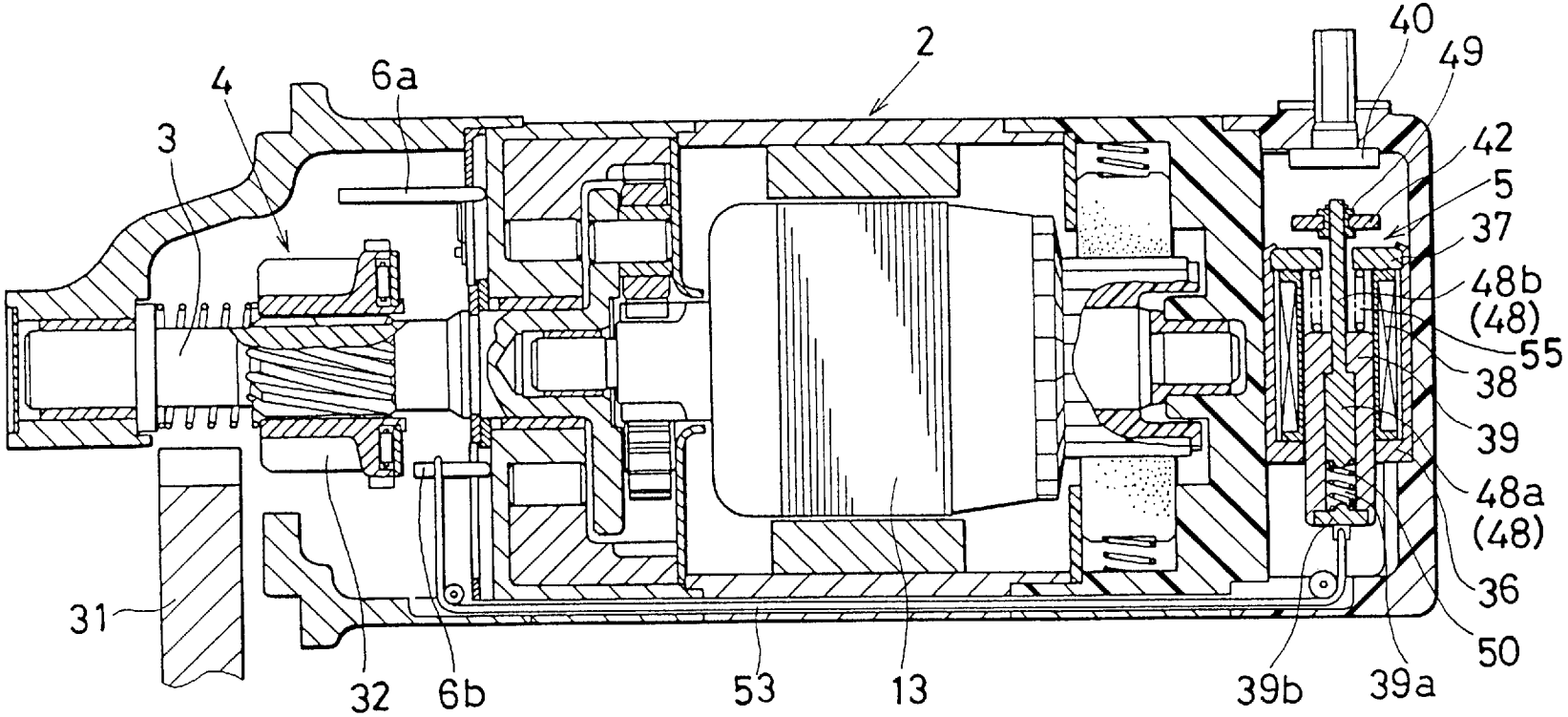
FIG. 5 is a cross sectional view of a starter using an electromagnetic switch according to a second embodiment.

In this embodiment, as shown in FIG. 5, the electromagnetic switch 5 has the cylindrical frame 36 having the opening at its bottom center, the grounding plate 37 fixed to the end opening of the frame 36, the attraction coil 38 housed within the frame 36, the plunger 39 disposed movably inside the attraction coil 38 and extending through the bottom opening of the frame 36, the rod 48 jointly movable with the plunger 39, and the like.

The plunger 39 has the hollow recess 39*a* which extends longitudinally at the radial center in the cross section (up-down direction in FIG. 5) and a through hole passing from the upper end of the hollow recess 39*a* to the top end surface of the plunger 39. The plug body 39*b* is fitted in the bottom of the plunger 39 to close the hollow recess 39*a*. The hollow recess 39*a* has the inner diameter larger than that of the through hole.

The rod 48 has a large diameter part 48*a* and a small diameter part 48*b*. The large diameter part 48*a* is disposed within the hollow recess 39*a* together with the contact spring 50 in a manner to be movable in the up-down direction within the hollow recess 39*a* in the plunger 39, while the small diameter part 48*b* is protruded upward through the through hole in the plunger 39. The bottom of the large diameter part 48*a* is substantially at the same elevation as the bottom surface of the frame 36.

The contact spring 50 is disposed between the bottom surface of the large diameter part 48*a* and the inner end surface of the plug body 39*b* fitted in the bottom of the plunger 39 so that it normally biases the rod 48 upward. Thus, the rod 48 is held with its step surface between the large diameter part 48*a* and the small diameter part 48*b* is in abutment with the step surface between the hollow recess 39*a* and the through hole. The contact spring 50 applies the contact pressure to the movable contact 42 through the rod 48, when the movable contact 42 attached to the rod 48 contacts both fixed contacts 40 and 41 in response to the movement (rise) of the plunger 39.

According to the present embodiment, as the contact spring 50 is housed within the hollow recess 39*a* of the plunger 39, leakage of magnetic flux from the small diameter part 48*b* of the rod 48 to the grounding plate 37 is restricted. That is, in the first embodiment, the magnetic flux leaks from the contact spring 50 to the grounding plate 37 and the loss of the attraction force occurs at the time the air gap is large where the large attraction force is required, because the contact spring 50 is disposed between the inner circumference of the through hole of the grounding plate 37 and the outer circumference of the rod 48. According to the present embodiment, on the contrary, the leakage of magnetic flux from the small diameter part 48*b* of the rod 48 to the grounding plate 37 is restricted so that the required attraction force may be generated effectively at the time the air gap is large. Further, the construction around the movable contact 42 can be simplified as opposed to the first embodiment in which the contact spring 50 is disposed near the movable contact 42.

The electromagnetic switch 5 in the present embodiment has a return spring 55 between the plunger 39 and the grounding plate 37. Thus, when the electric current to the attraction coil 38 is interrupted by opening the key switch 54 after starting the engine, the plunger 39 can be pushed back to return to its initial position (position shown in FIG. 5).

(Third Embodiment)

Figure 6:
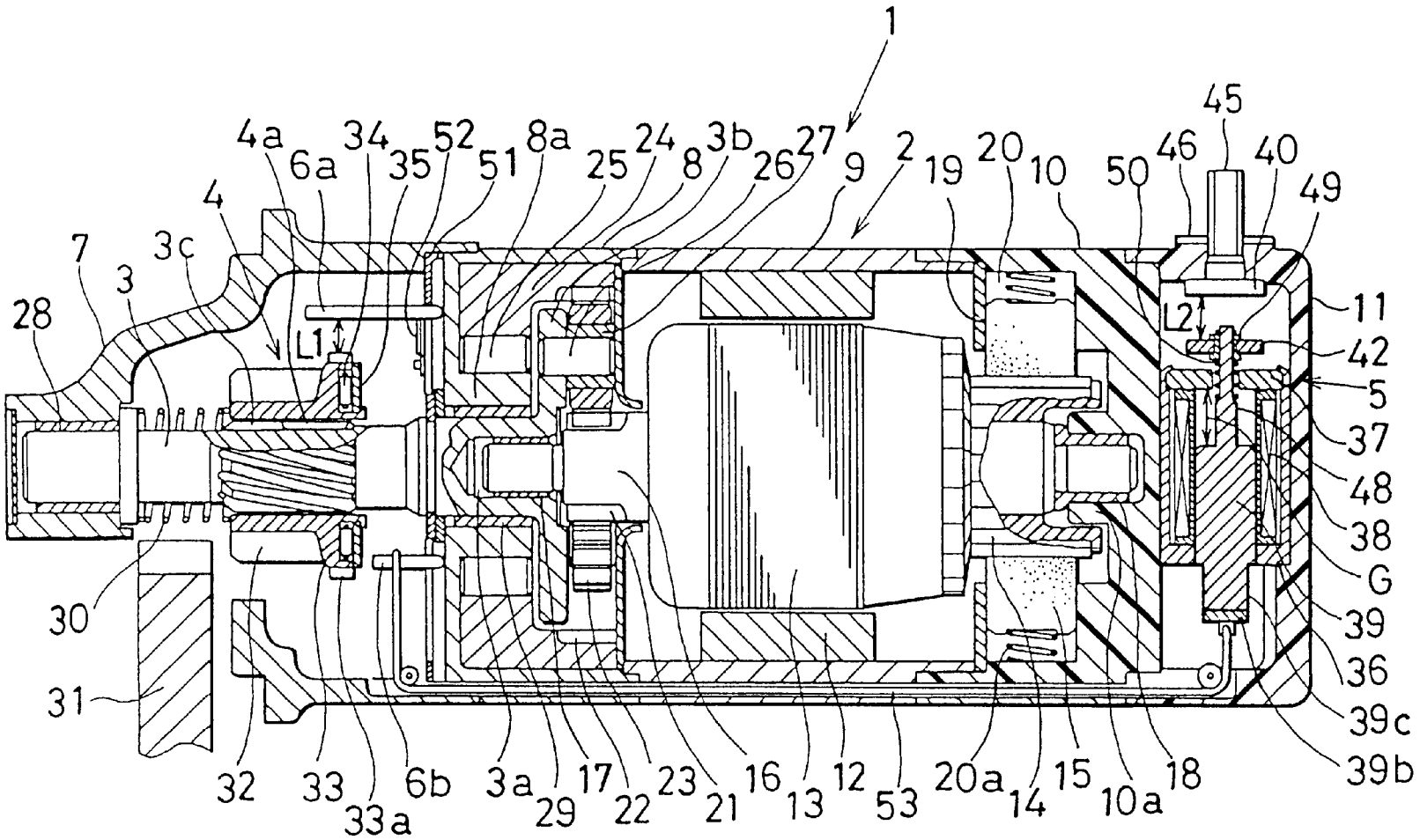
FIG. 6 is a cross sectional view of a starter using an electromagnetic switch according to a third embodiment.

As shown in FIG. 6, the plunger 39 is constructed to be small in diameter at the side of the bottom end opposite to the air gap G. This small diameter part 39*c* extends downward substantially from the same position as the bottom surface of the frame 36 under the condition where the electromagnetic switch 5 is at rest, that is, the plunger 39 is at its initial position (position shown in FIG. 6). That is, when the plunger 39 is at the initial position, the small diameter part 39*c* is located outside (below) the bottom surface of the frame 36.

As the plunger 39 is constructed to have the small diameter part 39*c* at the bottom side, the gap between the outer circumference of the plunger 39 (outer circumference of the small diameter part 39*c*) and the inner circumference of the frame 36 becomes large as the plunger 39 is attracted to move the small diameter part 39*c* into the frame 36. As a result, the magnetic resistance between the plunger 39 and the frame 36 increases and the attraction force of the electromagnetic switch 5 decreases, thus restricting the excess attraction force exceeding the spring force. As a result, the attraction speed of the plunger 39 decreases to suppress chatters between the contacts and prolong the life of the contacts.

As the small diameter part 39*c* of the plunger 39 is positioned outside the magnetic circuit, that is, the small diameter part 39*c* is located below the bottom surface of the frame 36, at the initial operation time of the electromagnetic switch 5, substantially the same required attraction force can be assured as in the conventional case.

Though the entire bottom part of the plunger 39 is reduced in diameter in the present embodiment, a groove or a recess may be provided alternatively at a part in the circumferential direction.

In the present embodiment, a separate return spring may be provided as in the first embodiment for pushing back the plunger 39 when the power supply to the attraction coil 38 is interrupted.

(Fourth Embodiment)

Figure 7:
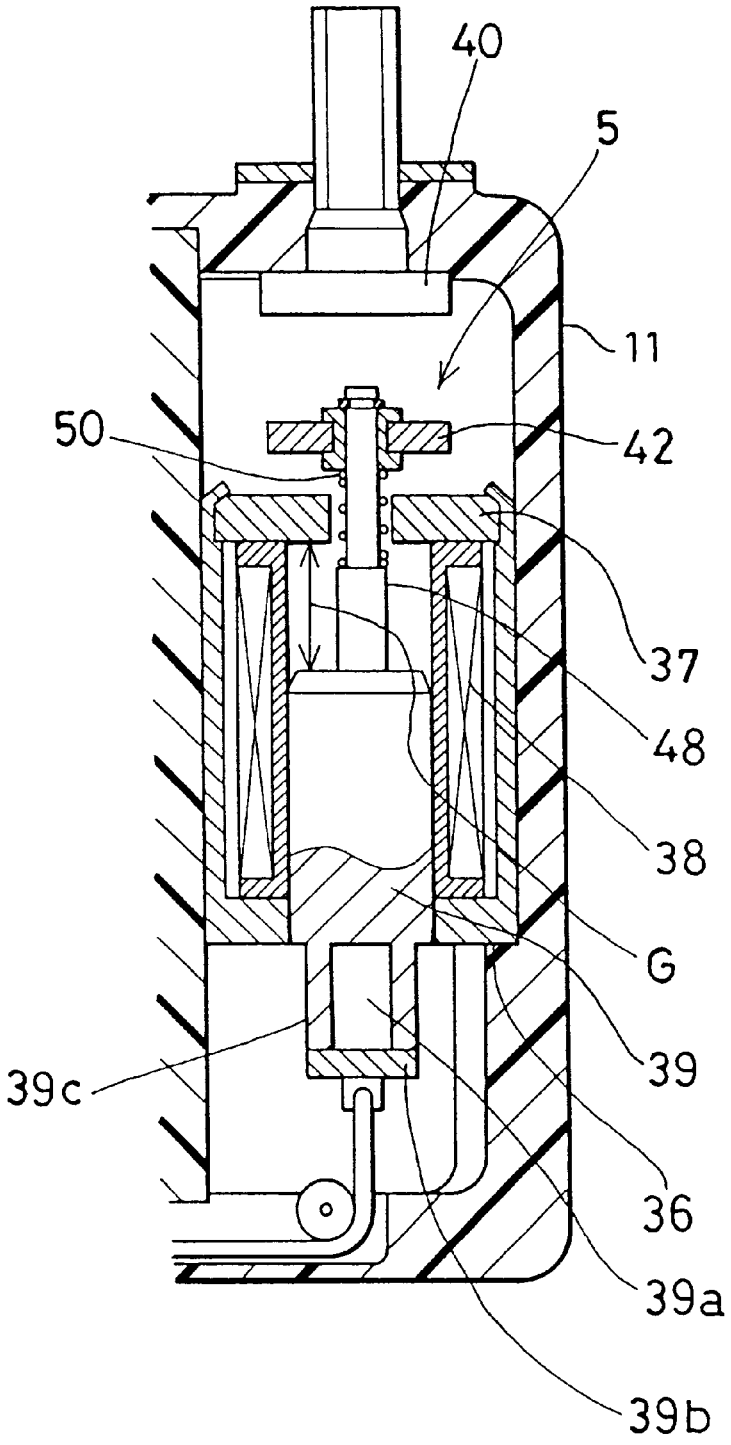
FIG. 7 is an enlarged cross sectional view of an electromagnetic switch according to a fourth embodiment.

As shown in FIG. 7, the plunger 39 may be constructed to have a combination of the hollow recess 39*a* provided in the second embodiment and the small diameter part 39*c* provided in the third embodiment. It is of course possible to dispose a low permeability material in the hollow recess 39*a*.

The present invention should not be limited to the disclosed embodiments and modifications, but may be implemented in many other ways and may be applied to various devices other than the starter for starting the engine.

I claim:

1. An electromagnetic switch for a starter having a starter motor which generates a rotating force, an output shaft which receives the rotating force of the starter motor for rotation, a pinion gear which receives the rotating force though a helical spline provided on the output shaft, and a rotation restricting member which restricts a rotation of the pinion gear when moved, the electromagnetic switch comprising:

a frame which forms a part of a magnetic circuit;

an attraction coil housed within the frame;

a plunger disposed movably within the attraction coil and connected to the rotation restricting member to open and close a motor switch provided in a power supply circuit of the starter motor and to control a movement of the rotation restricting member in response to a movement thereof, the plunger facing the frame through an air gap; and a variable magnetic resistance member which increases a magnetic resistance of the magnetic circuit as the plunger is attracted by the attraction coil to decrease the air gap.

2. The electromagnetic switch according to claim 1, wherein the variable magnetic resistance member includes a hollow recess provided at an end of the plunger at a position opposite to another end of the plunger near the air gap.

3. The electromagnetic switch according to claim 2, wherein the variable magnetic resistance member has a low permeability member disposed in the hollow recess.

4. The electromagnetic switch according to claim 1, wherein the variable magnetic resistance member has a reduced diameter part at an end of the plunger at a position opposite to another end of the plunger near the air gap.

5. The electromagnetic switch according to claim 2, further comprising:

a contact spring disposed within the hollow recess to apply a contact force to a movable contact of the motor switch when the movable contact abuts a fixed contact.

6. An electromagnetic switch for a starter comprising:

a frame which forms a part of a magnetic circuit; an attraction coil housed within the frame; and a plunger disposed movably within the attraction coil to form another part of the magnetic circuit, the plunger facing the frame through an air gap and having a variable magnetic resistance member which increases a magnetic resistance of the magnetic circuit as the plunger is attracted by the attraction coil to decrease the air gap.

7. The electromagnetic switch according to claim 6, wherein the variable magnetic resistance member includes a hollow recess provided at an end of the plunger at a position opposite to another end of the plunger near the air gap and normally located outside the frame to move into the magnetic circuit for restricting magnetic flux passing in the magnetic circuit when the plunger is attracted by the attraction coil.

8. The electromagnetic switch according to claim 6, wherein the variable magnetic resistance member has a low permeability member provided at an end of the plunger at a position opposite to another end of the plunger near the air gap and normally located outside the frame to move into the magnetic circuit for restricting magnetic flux passing in the magnetic circuit when the plunger is attracted by the attraction coil.

9. The electromagnetic switch according to claim 6, wherein the variable magnetic resistance member has a reduced diameter part at an end of the plunger at a position opposite to another end of the plunger near the air gap and normally located outside the frame to move into the magnetic circuit for restricting magnetic flux passing in the magnetic circuit when the plunger is attracted by the attraction coil.

10. The electromagnetic switch according to claim 6, further comprising:

a pair of fixed contacts provided between a motor and a battery; and a movable contact attached to the plunger for closing the fixed contacts when the plunger is attracted.

* * * * *